US007417587B2

(12) United States Patent
Iskander et al.

(10) Patent No.: US 7,417,587 B2
(45) Date of Patent: Aug. 26, 2008

(54) FERRITE PHASE SHIFTER AND PHASE ARRAY RADAR SYSTEM

(75) Inventors: Magdy F. Iskander, Honolulu, HI (US); Rory K. Sorensen, Salt Lake City, UT (US); Jar J. Lee, Irvine, CA (US); Hee Kyung Kim, El Segundo, CA (US)

(73) Assignee: Raytheon Company, Waltham, MA (US)

( * ) Notice: Subject to any disclaimer, the term of this patent is extended or adjusted under 35 U.S.C. 154(b) by 245 days.

(21) Appl. No.: 11/335,802

(22) Filed: Jan. 19, 2006

(65) Prior Publication Data

US 2007/0164838 A1 Jul. 19, 2007

(51) Int. Cl.
*H01Q 3/36* (2006.01)
*H01P 1/19* (2006.01)

(52) U.S. Cl. ..... 342/375; 333/161

(58) Field of Classification Search ..... 333/161, 333/158, 24.1; 342/372, 375
See application file for complete search history.

(56) References Cited

U.S. PATENT DOCUMENTS 4,102,572 A 7/1978 O'meara
4,816,787 A * 3/1989 Stern et al. ..... 333/158
4,881,052 A * 11/1989 Stern et al. ..... 333/24.1
5,223,808 A 6/1993 Lee et al.
5,828,271 A * 10/1998 Stitzer ..... 333/24.1
5,854,610 A * 12/1998 Wojtowicz et al. ..... 342/372
2003/0063366 A1 4/2003 Hunt

OTHER PUBLICATIONS

Sorensen et al. Low-Cost Nonplanar Microstrip-Line Ferrite Phase Shifter Utlizing Circular Polarization, IEEE Microwave and Wireless Components Letters, vol. 14, No. 1, Jan. 2004.

Sorensen et al. Low-Cost Nonplanar Microstrip-Line Ferrite Phase Shifter Utlizing Circular Polarization, 0-7803-8197-1/03 (c) 2003 IEEE.

* cited by examiner

*Primary Examiner*—Benny Lee
(74) *Attorney, Agent, or Firm*—Leonard A. Alkov

(57) ABSTRACT

A phase shifter comprises a substrate, a ground plane formed on a first surface of the substrate, a support structure positioned on a second surface of the substrate opposite the first surface, three parallel, non-co-planar microstrip lines supported by the support structure above the second surface of the substrate, a ferrite element supported by the support structure between the second surface of the substrate and the three non-co-planar microstrip lines, and means for applying a magnetic field to the ferrite element.

28 Claims, 4 Drawing Sheets

FIG. 1
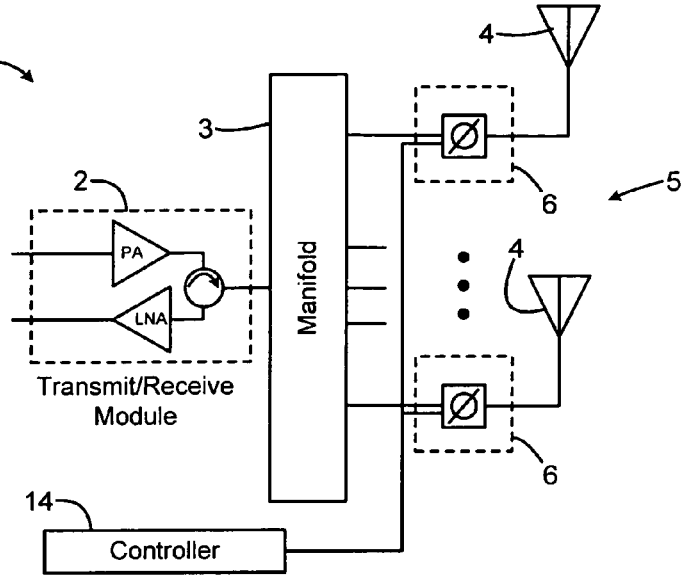
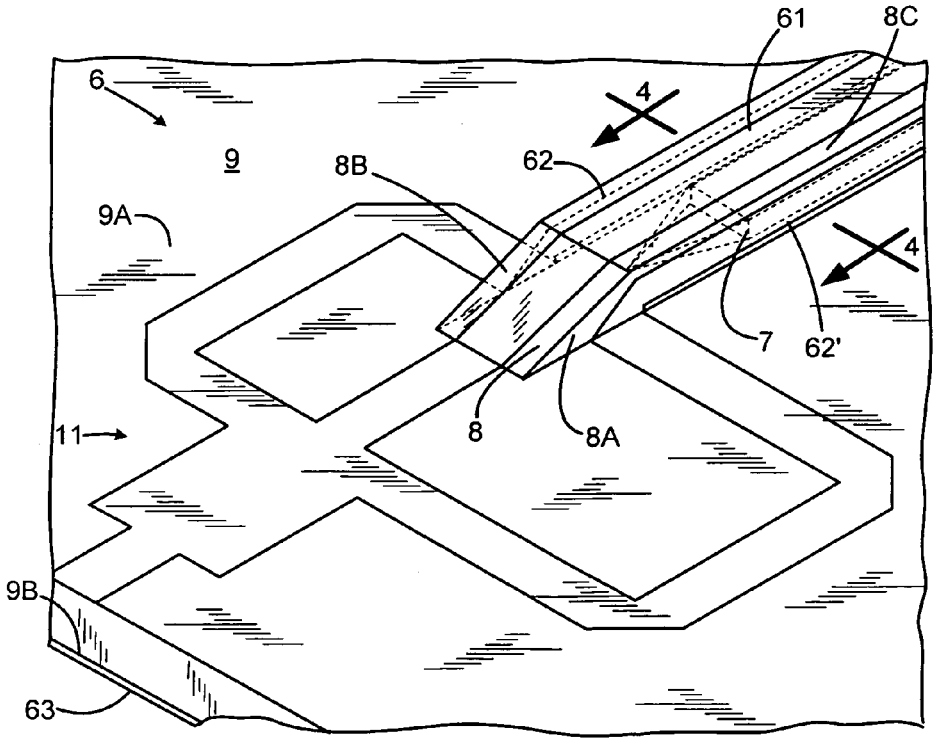
FIG. 2

FERRITE PHASE SHIFTER AND PHASE ARRAY RADAR SYSTEM

BACKGROUND OF THE DISCLOSURE

Transmission systems for electromagnetic waves, for example microwave and/or millimeter wave transmission systems, may include a phase shifter. Some embodiments of phase shifters comprise microstrips printed on a ferrite substrate. Some planar ferrite phase shifters create an elliptically polarized wave in a ferrite substrate, instead of a circularly polarized wave, thereby reducing the performance of the phase shifter. Other phase shifters are placed in metallized ferrite bars or ferrite-loaded waveguides, and/or incorporate thin quarter-wave plates at input and output ports to convert linear signals into circularly polarized signals. Such phase shifters may be expensive to manufacture.

SUMMARY

A phase shifter includes a substrate, with a ground plane formed on a first surface of the substrate and a support structure positioned on a second surface of the substrate opposite the first surface. Three parallel, non-co-planar microstrip lines are supported by the support structure above the second surface of the substrate. A ferrite element is supported by the support structure between the second surface of the substrate and the three non-co-planar microstrip lines. A magnetic circuit applies a magnetic field to the ferrite element.

BRIEF DESCRIPTION OF THE DRAWINGS

Features and advantages of the disclosure will readily be appreciated by persons skilled in the art from the following detailed description of exemplary embodiments thereof, as illustrated in the accompanying drawings, in which:

FIG. 1 illustrates a block diagram of a radar system.

FIG. 2 illustrates an exemplary embodiment of a phase shifter.

DETAILED DESCRIPTION OF THE DISCLOSURE

Figure 3:
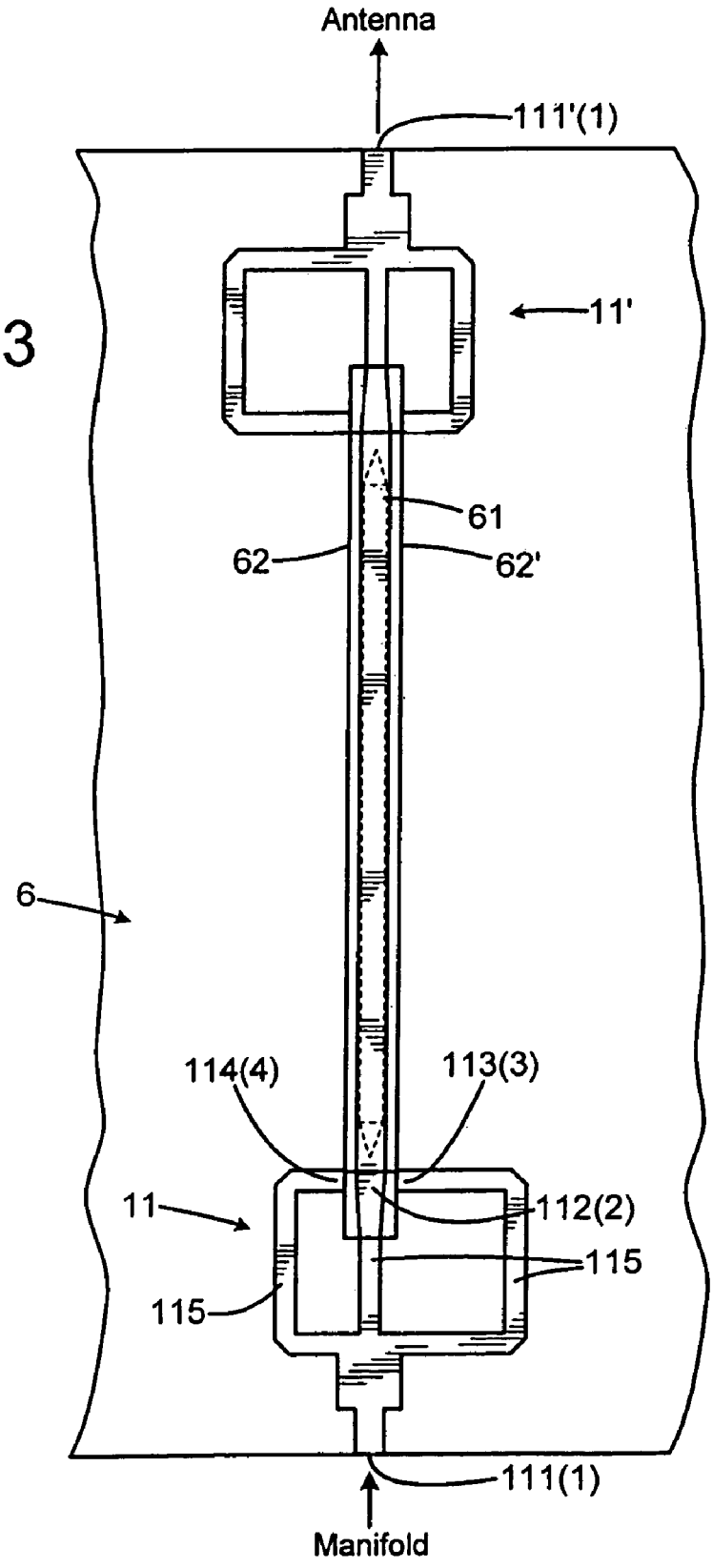
FIG. 3 illustrates a cross-sectional view of an exemplary embodiment of the phase shifter of FIG. 3.

In the following detailed description and in the several figures of the drawing, like elements are identified with like reference numerals which may not be described in detail for every drawing figure.

FIG. 1 is a block diagram of an exemplary embodiment of an electronically scanned phased array radar system 1. In an exemplary embodiment, the radar system 1 comprises a transmit/receive module 2, including a power amplifier PA, a low noise amplifier LNA and a circulator, a manifold 3 and a plurality of antenna elements 4. The antenna elements 4 are arranged in an array 5 and may be connected to the manifold through respective phase shifters 6. In exemplary embodiments, the phase shifters 6 individually shift the phase of signals to be transmitted by or received from the plurality of antenna elements 4 to electronically steer the array 5. A controller 14 may be provided to control the amount of phase shift applied by the phase shifters 6.

Figure 4:
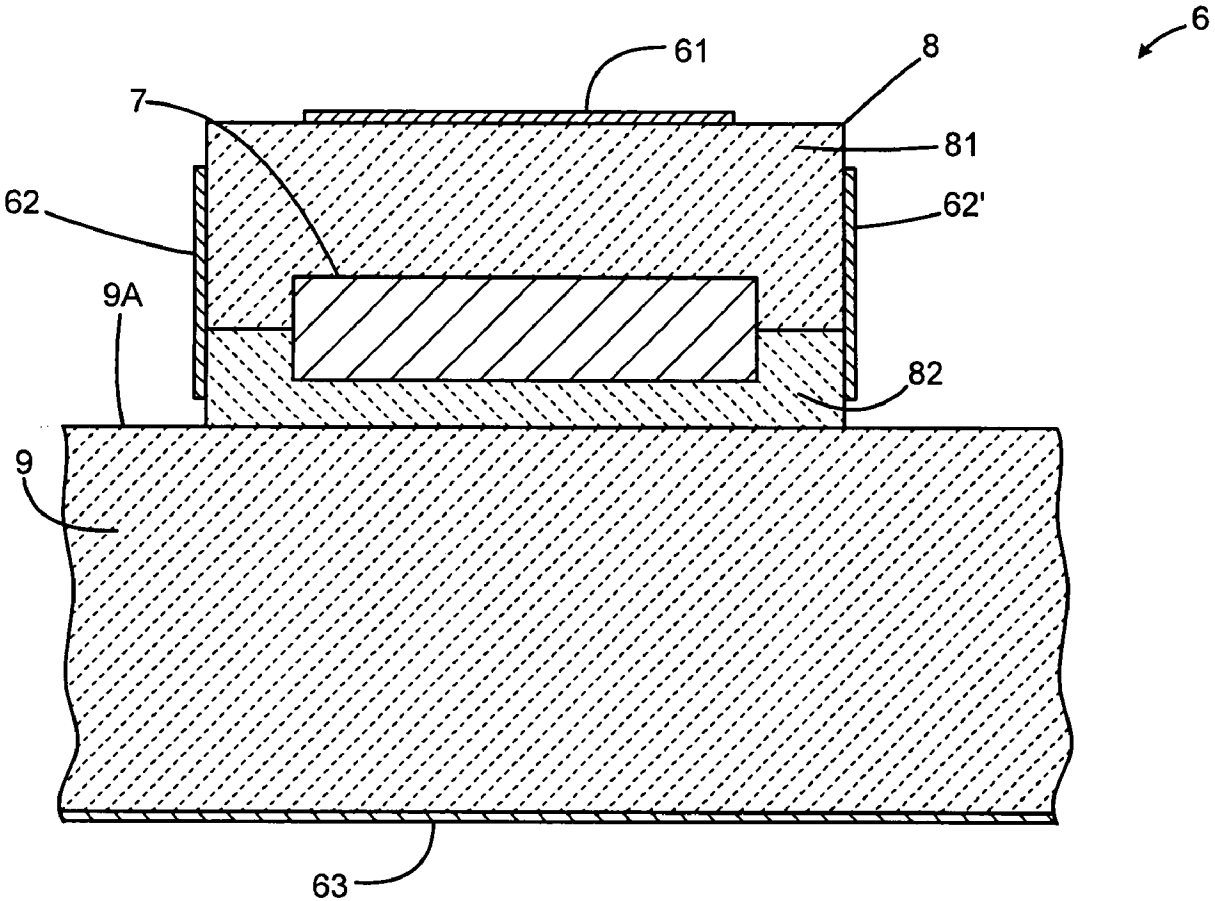
FIG. 4 illustrates a plan view of an exemplary embodiment of the phase shifter of FIGS. 2 and 3.
Figure 5:
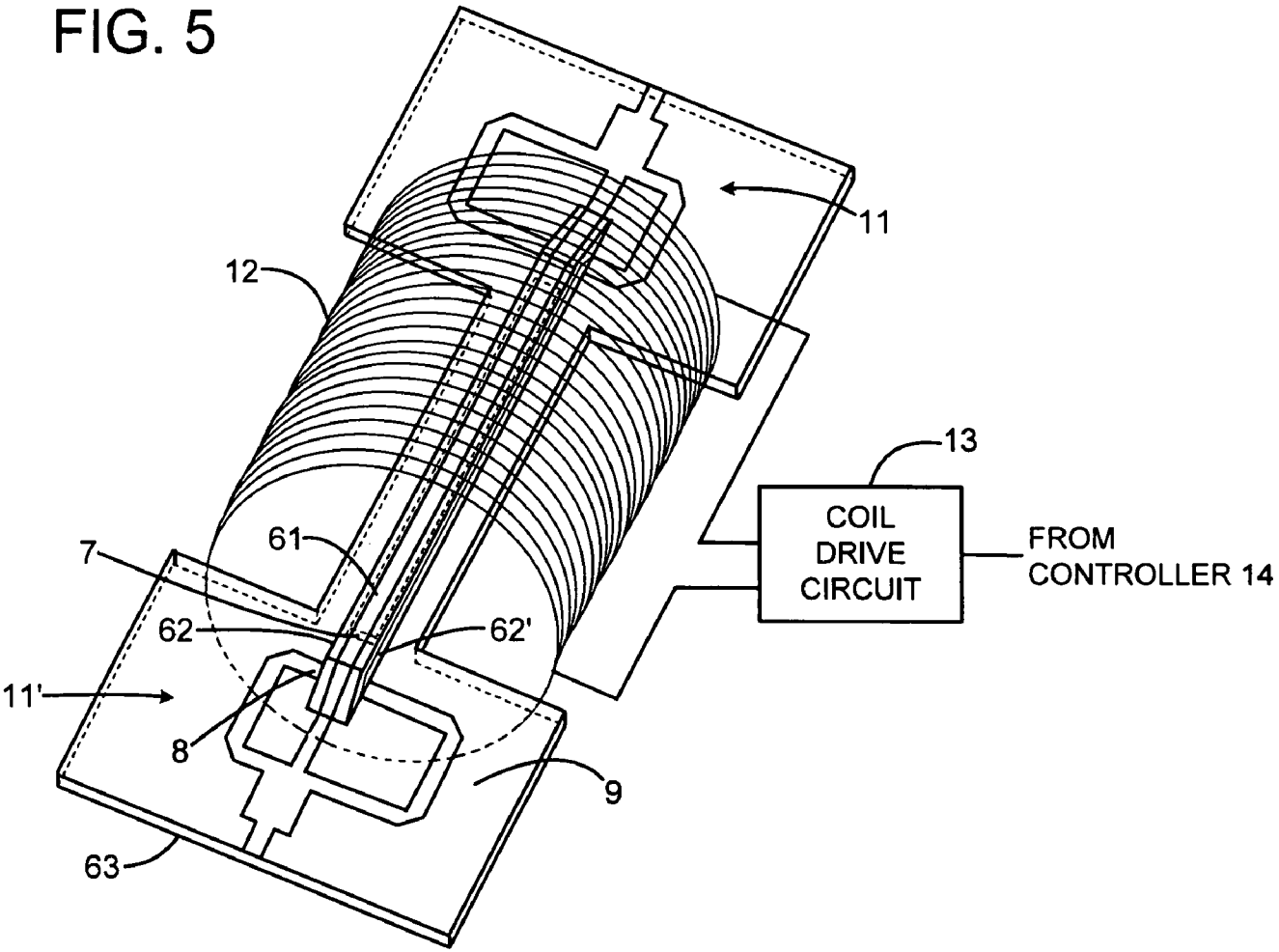
FIG. 5 illustrates an exemplary embodiment of a phase shifter with a bias coil.

FIGS. 2, 3 and 4 illustrate isometric, plan and cross-sectional views respectively illustrative of an exemplary embodiment of a phase shifter 6. In an exemplary embodiment, the phase shifter 6 comprises three parallel, non-co-planar microstrip conductor lines 61, 62, 62' positioned about a ferrite element 7 (FIGS. 2, 4). The ferrite element 7 may be implanted in or suspended in a support structure 8 between the top surface 9A of the substrate 9 and the microstrip lines 61, 62, 62' as shown in FIGS. 2, 4. In an exemplary embodiment, the support structure 8 is disposed on the top surface of the substrate 9 and the ground plane 63 (FIGS. 2, 4) is on an opposed surface 9B (FIG. 2) of the substrate 9. The amount of phase shift between an input/output (I/O) port 111(1) and an I/O port 111'(1) may be determined and adjusted by the strength of an applied bias magnetic field. In an exemplary embodiment, the bias magnetic field may be applied by a magnetic bias coil 12 (FIG. 5). In an exemplary embodiment, the magnetic bias coil 12 aligns the magnetic dipole moments of the ferrite material of the ferrite element 7 in the direction of propagation of a signal. The phase shifter 6 may be used in the active array system of FIG. 1.

In an exemplary embodiment, feed networks 11, 11' (FIG. 3) feed the microstrip lines 61, 62, 62' with energy of different magnitudes and phases. The feed networks 11, 11' may include microstrip, three-way power dividers. By combining the effects of the non-planar geometry of the microstrip lines 61, 62, 62' and the phase offsets introduced by the feed networks 11, 11', circularly polarized waves can be produced in the vicinity of the ferrite material of the ferrite element 7. If the signal is circularly polarized in the same direction as the precession of the magnetic dipole moments in the ferrite element 7, then the signal interacts strongly within the ferrite material, resulting in a greater phase shift over a shorter distance. In an exemplary embodiment, a phase shifter may provide a desired circularly polarized wave along the entire length of the ferrite element, thereby maximizing the interaction with the ferrite material and enhancing the Faraday rotation.

In an exemplary embodiment, a phase shifter may achieve a phase shift of approximately 48 degrees per centimeter. For example, a phase shifter with a line length (active region) of 7 cm, center microstrip conductor 61 width of about 3 mm on the top surface of the support structure 8, lateral microstrip conductor 62, 62' width of about 2.5 mm on the side surfaces of support structure 8. The height of support structure 8 may be about 5 mm. The substrate 9 may have a thickness or height of 2 mm. The ferrite element 7 has a length of 7 cm, a height of 1.5 mm and a width of 3 mm. The ends of the support structure 8 in this embodiment have 45° tapers.

The low cost, small size and large phase shifts obtainable by exemplary embodiments may be particularly desirable for use in high-gain phased array radar systems with thousands of phase shifters may be used to steer a beam of an antenna array.

In an exemplary embodiment, the three non-co-planar microstrip conductor lines 61, 62, 62' comprise a center microstrip line 61 and two lateral microstrip lines 62, 62'. The center microstrip line 61 extends along a longitudinal axis and is in a plane which is generally parallel with a plane defined by the ground plane 63 and with the top surface 9A of the substrate 9. The lateral microstrip lines 62, 62' are laterally separated from each other on opposite sides of, generally parallel with and alongside the center microstrip line 61 and lie in planes which are tilted downward and away from the plane of the center microstrip line in a direction toward the top surface 9A of the substrate 9. In an exemplary embodiment, the planes defined by the lateral microstrip lines 62, 62' are tilted along an axis parallel with the longitudinal axis of the center microstrip line 61 at an angle of 90 degrees downward and away from the plane of the center microstrip line 61. Other angles, e.g. 45 degrees, may also be employed. The lateral microstrip lines 62, 62' may be closer to the ground plane 63 than is the center microstrip line 61. In an exemplary embodiment, the ferrite element 7 is between the center microstrip line 61 and the top surface 9A of the substrate 9 and between the two lateral microstrip lines 62.

In an exemplary embodiment, the microstrip lines 61, 62, 62' and/or the ground plane 63 may comprise copper tape, for example smooth copper tape, and may have conductive acrylic adhesive for securing the tape to the substrate 9 and/or support structure 8. Suitable copper tape may be available from the 3M Corporation. In an exemplary embodiment, the microstrip lines 61 may be about 3 mm wide and the microstrip lines 62, 62' may be about 2.5 mm wide. The microstrips may be attached to a substrate by any suitable means, including, for example, adhesive, or preferably fabricated by photolithographic techniques.

As noted above, in an exemplary embodiment, the microstrip lines 61, 62, 62' are supported by the support structure 8. The support structure 8 may be, for example, on a surface a substrate 9, for example on a top surface, and the ground plane may be on the opposed surface of the substrate 9, for example the bottom surface. In an exemplary embodiment, the support structure 8 may comprise a part of the substrate 9. In one exemplary embodiment, the ferrite element 7 may be disposed within the support structure 8 and between the ground plane 63 and the center microstrip line 61, and positioned on the top surface of the substrate 9. In this case, the ferrite element is disposed in a channel formed in the support structure 8. In an alternate exemplary embodiment, the ferrite element 7 may be embedded within the support structure 8 such that it is located a distance above the top surface of the substrate 9.

In an exemplary embodiment, the ferrite element 7 may comprise nickel aluminum ferrite. The ferrite element 7 may have, for example, a rectangular configuration, optionally with tapered ends. In an exemplary embodiment, the ferrite element 7 may have, for example, a dielectric constant of about 10, a dielectric loss tangent of less than about 0.0002, a saturation magnetization of about 600 Gauss, and a ferromagnetic resonance line width ($\Delta$ H) at half peak of about 265 Oe (Oersted Units). Suitable ferrite elements 7 may be available from Countis Industries in Carson City, Nev. In an exemplary embodiment, the ferrite element 7 may be a slab, for example with a rectangular cross-section of about 1.5 mm high and about 3 mm wide and about 2 wavelengths long at an operating frequency within the band. For example, for an embodiment with a 3 GHz operating frequency, the ferrite element 7 may be about 7.00 cm long. Alternatively, the ferrite element 7 may be in the form of a cylindrical rod; Another nominal operating frequency is in a range from about ten to sixteen GHz.

In an exemplary embodiment, the substrate 9 comprises a dielectric, for example a ceramic substrate such as ROGERS TMM-10i, available from ROGER'S CORPORATION in Chandler, Ariz. The substrate 9 may have, for example, a dielectric constant of about 9.8 and a dielectric loss tangent of less than about 0.002.

In an exemplary embodiment, the support structure 8 may be fabricated of the same dielectric material as the substrate 9. In an exemplary embodiment, the support structure 8 comprises a ceramic substrate. In an exemplary embodiment, a cross-section of the support structure 8 is rectangular. For example, the top surface may be parallel with a plane defined by the ground plane 63 and/or the substrate 9. The two sides 8A, 8B (FIG. 2) may be perpendicular with the plane of the top surface 8C (FIG. 2) of the support structure 8. In an exemplary embodiment, the center microstrip line 61 is disposed on the top surface of the support structure and the lateral microstrip lines 62, 62' are disposed on the sides of the support structure 8, as shown in FIG. 4.

In an exemplary embodiment, the support structure 8 may be formed of at least two parts—a top portion 81 and a bottom portion 82, as shown in FIG. 4. In an exemplary embodiment, the ferrite element 7 may be placed in a channel in the bottom portion 82 of the support structure 8. A top portion 81 of the support structure 8 may be placed over the element 7 and the bottom portion 82 and secured in place, for example by gluing. In an exemplary embodiment, the top part 81 may include material with a dielectric constant of about 9.8. In an exemplary embodiment, the bottom portion may be of the same dielectric material as the substrate 9.

In an exemplary embodiment, the phase shifter 6 comprises two feed networks 11, 11' (FIG. 3). The feed networks 11, 11' may, for example, include power divider, quarter-wave transformers. The feed networks 11, 11' are placed one on either end of the support structure 8. The feed networks 11 and 11' have similar structures and functions, the function depends on the direction of travel of a signal either transmitted or received through the phase shifter. For simplicity, only the structure of feed network 11 is described here.

The feed network 11 comprises an I/O port 111(1), a reference port 112(2) connected to the center microstrip line 61, a port 113(3) connected to lateral microstrip line 62 and port 114(4) connected to lateral microstrip line 62' (the parenthetical port numbers (1), (2), (3), (4) are given here as references for S parameter values, S11, S21, S31, S41, stated below). The port 111(1) is coupled to port 112(2), port 113(3) and port 114(4) by transmission conductor lines 115. In an exemplary embodiment, the transmission lines 115 are microstrip transmission lines and may comprise strip conductors fabricated on the substrate surface using photo-lithographic techniques and may have a width of about 1.87 mm. In an exemplary embodiment, the lengths of transmission lines 115 are arranged so that the phases of the electromagnetic signals at ports 113(3) and 114(4) are about +90 degrees and −90 degrees, respectively, with respect to the signal at the reference port 112(2). In an exemplary embodiment, the transmission lines 115 may have lengths of about 4.9 (longer outer leg) cm, 3.1 cm (shorter outer leg) and 0.76 cm (center), for an operating frequency of about 3 GHz. In an exemplary embodiment, ideally, S11 is infinity dB, S21 is −3 dB, S31 is −6 dB and S41 is −6 dB. In an exemplary embodiment, one of the feed networks 11, 11' is connected to a manifold 3 of a radar system 1 (FIG. 1), for receiving at input port 111(1), a radar signal to be transmitted, and the other feed network 11' is connected to an antenna element 4 in an array 5 (FIG. 1), for transmitting from the output port 111'(1), a radar signal from the antenna element 4. The array 5 is steered by adjusting the phases of the various signals being transmitted by the plurality of antenna elements 4 in the array. In an exemplary embodiment, the phase difference between a signal from the manifold at the I/O port 111 of the feed network 11 and the signal at the I/O port 111' of the other feed network 11' to be transmitted by an antenna element 4 is determined by the strength of an applied bias magnetic field.

FIG. 5 illustrates an exemplary embodiment of a phase shifter with a coil 12. In an exemplary embodiment, the applied bias magnetic field is applied by the current-carrying coil 12 wrapped around the ferrite element 7 of the phase shifter 6. In an exemplary embodiment, the current is a DC current provided by a coil drive circuit 13, e.g., a DC source, and may be in a range from about 0 KA/m to 200 KA/m. The coil drive circuit 13 is controlled by the array controller 14(FIG. 1) when the phase shifter is employed in the array of FIG. 1 to apply a variable current drive selected to achieve a desired phase shift value.

The coil 12 extends around the ferrite element, the support structure 8, at least a portion of the substrate 9 and at least a portion of the ground plane 63. In an exemplary embodiment, portions of the substrate 9 and the ground plane 63, on the bottom surface of the substrate 9, may be cut back, for example forming a "dumbbell" shape, to make space for the coil 12 as shown in FIG. 5.

In an exemplary embodiment, the coil 12 may comprise 22 AWG (22 gauge wire with insulation), with a coil size of 17.5 cm×8 cm×2.5 cm. In an exemplary embodiment, the coils may include four layers of wires with 56 turns/cm. In an exemplary embodiment, the axis of the coil 12 runs parallel with the longitudinal axis of the center microstrip 61. In an exemplary embodiment, the coil runs substantially the entire length of the microstrip line 61 or about 7.5 cm. In an exemplary embodiment, shortening the length of the coil may reduce phase shift but may improve impedance matching. The controller 14 adjusts the current through the coils to create the desired magnetic field so that a signal transmitted through the phase shifter is shifted by a desired amount.

In an exemplary embodiment, the arrangement of the microstrip lines 61, 62, 62', the ferrite element 7 and the ground plane 63 provide strong vertical and strong horizontal polarization, resulting in a circular polarization of a signal transmitted through the phase shifter 6.

In an exemplary embodiment, a phase shifter can be a broad band phase shifter, for example a 2-4 GHz or 8-12 GHz phase shifter. The desired microstrip line widths for a given application may be affected mostly by the dielectric constant and substrate thickness, but may also be affected by high frequency effects related to the effective dielectric constant. In a broad band phase shifter, the microstrip line width may be designed around about the center frequency of the design band. In an exemplary embodiment, the feed networks may be impedence matched at the 3-to-1 junction. For broad band operation, a phase shifter may be provided with multi-section transformers and/or be provided with analog bias to achieve the desired phase relationships at the ports feeding the three parallel microstrip lines for the particular frequency or frequencies being phase-shifted.

In an exemplary embodiment, a phase shifter could be encapsulated in dielectric with a built-in magnetic bias coil. The bias coil may comprise, for example, conductive vias through a substrate and conductive traces along the surfaces of the substrate. In an exemplary embodiment, the microstrip lines could be placed directly on a ferrite substrate or structure instead of above a ferrite element supported within a support structure. In an exemplary embodiment, such a ferrite substrate or structure may have a shape similar to those of the support structures 8 shown in FIGS. 2-4.

It is understood that the above described embodiments are merely illustrative of the possible specific embodiments which may represent principles of the present invention. Other arrangements may readily be devised in accordance with these principles by those skilled in the art without departing from the scope and spirit of the invention. The terms top and bottom and up and down are used herein for convenience to designate relative spatial relationships among various features in various embodiments.

What is claimed is:

1. A phase shifter comprising:

a substrate;

a ground plane disposed on a first surface of the substrate;

a support structure positioned on a second surface of the substrate opposite the first surface;

three parallel, non-co-planar microstrip lines supported by the support structure above the second surface of the substrate;

an elongated ferrite element supported within the support structure between the second surface of the substrate and the three non-co-planar microstrip lines; and means for applying a magnetic field to the ferrite element; and wherein the support structure comprises a bottom dielectric element, and a top dielectric element, the ferrite element being embedded within said bottom dielectric element and said top dielectric element.

2. The phase shifter according to claim 1, wherein the microstrip lines are disposed on a surface of a substrate by photolithographic techniques.

3. The phase shifter according to claim 1, wherein the phase shifter has a nominal operating frequency and the ferrite element has a length of about two wavelengths of the nominal operating frequency.

4. The phase shifter according to claim 1, wherein the phase shifter has a nominal operating frequency in a range from about ten to sixteen GHz.

5. The phase shifter according to claim 1, wherein the ferrite element has a rectangular cross-section.

6. The phase shifter according to claim 1, wherein the substrate comprises a dielectric.

7. The phase shifter according the claim 1, wherein the three non-co-planar microstrip lines are disposed on respective ones of three non-co-planar surfaces of the support structure.

8. The phase shifter according to claim 1, wherein the three non-coplanar microstrip lines comprise a center microstrip line in a first plane substantially parallel to the groundplane and first and second lateral microstrip lines which are in planes substantially perpendicular to the first plane.

9. The phase shifter according to claim 1, wherein the support structure comprises a dielectric.

10. The phase shifter according to claim 1, wherein the substrate and the support structure are fabricated of the same dielectric material.

11. The phase shifter according to claim 1, wherein the means for applying a magnetic field aligns the magnetic dipole moments of the ferrite element in a direction of transmission of a signal.

12. The phase shifter according to claim 1, wherein said bottom dielectric element has a channel disposed therein to receive said ferrite element.

13. The phase shifter according to claim 1, wherein said ferrite element is a nickel aluminum ferrite element.

14. The phase shifter according to claim 1, further comprising:

a first feed network connected to the three non-co-planar microstrip lines at a first end of the phase shifter.

15. The phase shifter according to claim 14, further comprising a second feed network connected to the three non-co-planar microstrip lines at a second end of the phase shifter.

16. The phase shifter according to claim 15, wherein the first feed network comprises:

a network of transmission lines connecting an input port, a reference port, and first and second non-reference ports, wherein the reference port is connected to a center one of the three non-co-planar microstrip lines and the first and second non-reference ports are connected to respective first and second lateral microstrip lines of the three non-co-planar microstrip lines.

17. The phase shifter according to claim 16, wherein:

the network of transmission lines comprises a junction connected to a reference transmission line and first and second non-reference lines, wherein the reference transmission line is connected to the reference port, the first non-reference line is connected to the first non-reference port and the second non-reference transmission line is connected to the second non-reference port.

18. The phase shifter according to claim 16, wherein a signal received at the input port is divided into a reference signal and two non-reference signals, wherein at the first non-reference port, the first non-reference signal is about +90 degrees out of phase with respect to the reference signal at the reference port and the second non-reference signal is about −90 degrees out of phase with respect to the reference signal at the reference port.

19. A phase shifter comprising:

a substrate;

a ground plane disposed on a first surface of the substrate;

a support structure positioned on a second surface of the substrate opposite the first surface:

three parallel, non-co-planar microstrip lines supported by the support structure above the second surface of the substrate;

an elongated ferrite element supported within the support structure between the second surface of the substrate and the three non-co-planar microstrip lines; and means for applying a magnetic field to the ferrite element, wherein the means for applying a magnetic field comprises a coil around the ferrite element, and wherein portions of the substrate and the ground plane are relieved to provide a dumbbell shape and provide a space for the coil.

20. A phase shifter comprising:

a substrate;

a ground plane disposed on a first surface of the substrate;

a support structure positioned on a second surface of the substrate opposite the first surface;

three parallel, non-co-planar microstrip lines supported by the support structure above the second surface of the substrate;

an elongated ferrite element supported within the support structure between the second surface of the substrate and the three non-co-planar microstrip lines, wherein the ferrite element has a generally rectangular cross-sectional configuration, with tapered ends; and means for applying a magnetic field to the ferrite element.

21. An electronically scanned phased array radar system, comprising:

a transmit/receive module, including a power amplifier, a low noise amplifier LNA and a circulator;

a manifold;

a plurality of antenna elements arranged in an array and connected to the manifold through a plurality of respective phase shifters;

the respective phase shifters arranged to individually shift the phase of signals to be transmitted by or received from the plurality of antenna elements to electronically steer a beam of the array;

a controller connected to the phase shifters to control the amount of phase shift applied by the phase shifters to controllably steer the array beam; and wherein one or more of the phase shifters comprises:

a substrate;

a ground plane disposed on a first surface of the substrate;

a dielectric support structure positioned on a second surface of the substrate opposite the first surface;

three parallel, non-co-planar microstrip lines supported by the support structure above the second surface of the substrate;

a ferrite element supported in the support structure between the second surface of the substrate and the three non-co-planar microstrip lines, wherein said dielectric support structure has a channel disposed therein to receive said ferrite element; and a magnetic circuit for applying a magnetic field to the ferrite element under control of the controller.

22. The phase shifter according to claim 21, wherein the support structure comprises a bottom dielectric element, and a top dielectric element, the ferrite element being embedded within said bottom dielectric element and said top dielectric element.

23. The array of claim 21, wherein the magnetic circuit comprises a coil surrounding a longitudinal extent of the ferrite element and a coil drive circuit connected to the coil and controller by the controller.

24. A phase shifter comprising:

three parallel, non-co-planar microstrip lines supported on a dielectric support structure;

a dielectric substrate having opposed first and second surfaces;

a ground plane disposed on said second surface;

a ferrite element supported within the dielectric support structure between the first surface of the substrate and the three non-co-planar microstrip lines, wherein the ferrite element has a generally rectangular cross-sectional configuration, with tapered ends;

a magnetic circuit for generating a magnetic field for aligning magnetic dipole moments of the ferrite element; and a control circuit for varying the magnetic field for adjusting a phase shift of a signal transmitted through the phase shifter.

25. The phase shifter according to claim 24 wherein the means for generating a magnetic field comprises a bias coil.

26. The phase shifter according to claim 24, wherein said ferrite element is a nickel aluminum ferrite element.

27. The phase shifter according to claim 24, wherein said dielectric support structure has a channel disposed therein to receive said ferrite element.

28. The phase shifter according to claim 24, wherein the dielectric support structure comprises a bottom dielectric element, and a top dielectric element, the ferrite element being embedded within said bottom dielectric element and said top dielectric element.

* * * * *